United States Patent [19]

Ballarini et al.

[11] 4,371,430

[45] Feb. 1, 1983

[54] ELECTRODEPOSITION OF CHROMIUM ON METAL BASE LITHOGRAPHIC SHEET

[75] Inventors: John A. Ballarini; Timothy A. Hetland, both of Racine, Wis.

[73] Assignee: Printing Developments, Inc., Racine, Wis.

[21] Appl. No.: 134,636

[22] Filed: Apr. 11, 1980

Related U.S. Application Data

[63] Continuation-in-part of Ser. No. 34,179, Apr. 27, 1979, abandoned.

[51] Int. Cl.[3] ..... C25D 5/44; G03C 1/94

[52] U.S. Cl. ..... 204/32 R; 204/33; 204/34; 204/51; 430/276; 430/525

[58] Field of Search ..... 204/33, 51, 34, 32 R; 430/526, 525, 276, 278

[56] References Cited

U.S. PATENT DOCUMENTS

| | | | |
|---|---|---|---|
| 2,091,386 | 8/1937 | Viers | 204/7 |
| 2,847,371 | 8/1958 | Topelian | 204/33 |
| 2,992,171 | 7/1961 | MacLean | 204/51 |
| 3,098,804 | 7/1963 | Wittrock | 204/41 |
| 3,493,474 | 2/1970 | Weber | 204/33 |
| 3,672,964 | 6/1972 | Bellis | 204/33 |
| 3,929,594 | 12/1975 | Fromson | 204/42 |
| 3,979,212 | 9/1976 | Peters et al. | 96/86 R |

OTHER PUBLICATIONS

F. A. Lowenheim, Electroplating, McGraw-Hill, New York, 1978, p. 129.

Metal Finishing Guidebook and Directory for 1978, Metals and Plastics Publications, Inc., Hackensack, N.J., pp. 156, 160-161.

*Primary Examiner*—Winston A. Douglas
*Assistant Examiner*—William Leader
*Attorney, Agent, or Firm*—Nims, Howes, Collison & Isner

[57] ABSTRACT

Electrodeposition of chromium of selectively constituted crystalline character and grain texture on metal substrates, such as aluminum or steel base lithographic sheet to provide improved and directly chromium plated aluminum or steel base lithographic sheet capable of operatively functioning as a surface plate after exposure of an applied photo sensitive coating thereon.

14 Claims, 52 Drawing Figures

ELECTRODEPOSITION OF CHROMIUM ON METAL BASE LITHOGRAPHIC SHEET

This application is a continuation-in-part of our application Ser. No. 034,179 filed Apr. 27, 1979, now abandoned.

BACKGROUND OF INVENTION

This invention relates to the electrodeposition of chromium of selectively constituted crystalline character directly on metal substrates and particularly to the fabrication of improved aluminum and steel base lithographic sheet having fine secondary grained chromium directly plated thereon that can operatively function as a surface plate after exposure of an applied photo sensitive coating thereon.

Bi-metal and tri-metal lithographic plates have long been employed as an alternative to deep etch plates in the lithographic arts. Among the multimetal layered lithographic plates that have been commercially employed are the IPI tri-metal plate formed of a steel or zinc base sheet having an intermediate layer of plated copper and a surface layer of chromium plated over the copper; the "Lithure" plate formed initially of a copper sheet plated with chromium and, more recently, of an aluminum base sheet having an intermediate layer of plated copper and a surface layer of chromium plated thereon; the "Aller" plate formed of a stainless steel base plate overlaid with plated copper; and the "Lithengrave" plate comprising a copper plated aluminum base sheet. For the purposes of convenience both 1000 series aluminum sheet, such as 1100, and other aluminum alloy sheet used for lithographic plates, such as 3000 series sheet will be hereinafter termed generally as "aluminum" sheet or "aluminum base" sheet.

In a similar manner steel sheet whether of mild or low carbon steel or of stainless steel will be hereinafter termed generally as "steel" sheet or "steel base" sheet.

The use of steel as a basal sheet substrate for lithograph plate because of its mechanical strength and resistance to cracking on printing presses has long been recognized. As indicated above however such steel base substrates are usually provided with an intermediate coating or layer of another metal, usually copper, between the steel substrate and the electrodeposited chromium.

Although chromium has long been recognized as a preferred surface metal for lithographic sheet and aluminum has long been recognized as a convenient and relatively inexpensive basal sheet substrate therefor, the direct plating of chromium on aluminum base sheet has been a long-sought but hitherto unattainable objective in the lithographic art. The patented art is replete with disclosures delineating the difficulties of directly plating chromium on aluminum or aluminum base substrates and the practical necessity of the incorporation of an intermediate coating therebetween. Whether such difficulties are attributable to the rapidity of oxide formation on aluminum surfaces or are attributable to a basic incompatability between the surface or plating adhesion characteristics of aluminum and chromium, the practical art has always had to employ an intermediate coating, most usually of another metal, such as zinc, or flash coatings, such as copper, to effectively modify the aluminum base surface characteristics to permit chromium to be plated thereon.

This invention may be briefly and broadly described as an improved process for electrodepositing chromium of selectively constituted crystalline character and grain texture directly on aluminum and steel base substrates. In its narrower aspects, the invention may be described as an improved aluminum or steel base bi-metal lithographic plate having a fine secondary grained and interfacially adherent directly plated chromium surface of selectively constituted crystalline character and fine secondary grain texture formed of progressively agglomerated spheroids, and to processes for forming such lithographic plates from aluminum and steel base substrates. In a still further aspect, the invention includes an improved interfacial adherence between such electrodeposited chromium layer and an overlying coating of photo sensitive material.

Among the advantages of the subject invention is the provision of directly electrodeposited chromium surface layers of fine secondary grained, closely adherent character that are characterized by a selectively constituted crystal structure and grain texture on base metal substrates such as aluminum and steel. Other advantages include the provision of a chromium-surfaced aluminum base lithograph plate that operatively functions, after exposure of an applied coating of photo sensitive material, as a surface plate; that is possessed of increased press life in terms of permitted impressions per plate, together with improved abrasion resistance, corrosion resistance, durability and greater resistance to plate cracking. Still further advantages of the subject invention are the provision of a chromium surfaced bi-metal lithographic plate that operatively functions as a surface plate and that is markedly superior in photo sensitive coating adhesion, water carrying ability and tolerance for fountain solutions of varying pH. Additional advantages include increased efficiency of chromium plating and provision of a fine secondary grained and closely adherent directly plated chromium surface layer for lithographic plates of markedly improved character, which provide increased latitude for operator error when using press chemicals and abrasive ink pigments.

The primary object of this invention is the provision of a directly plated chrome surface layer for aluminum and steel base lithograph plate that is operably functional, after exposure, as a surface plate.

Another primary object of this invention is the provision of improved chromium plated surfaces characterized by a selectively constituted crystal structure and grain texture and plating processes to obtain the same.

Another object of this invention is provision of improved aluminum and steel base lithographic plate having a chromium layer directly plated on the surface thereof.

Another object of this invention is the provision of aluminum and steel base lithograph plate having a selectively constituted, fine secondary grained and closely adherent coating of directly deposited chromium on the surface thereof.

Still another object of this invention is the provision of directly chromium plated aluminum and steel base lithographic plate that is operable as a surface plate and which is markedly superior in photo sensitive coating adhesion, water carrying ability, corrosion and mechanical wear resistance.

Other objects and advantages of the invention will become apparent from the following portions of this specification and from the appended drawings which illustrate, in accord with the mandate of the patent statutes, a presently preferred embodiment of the invention, and, in particular, the surface characteristics of the improved fine grained and closely adherent surface layer of plated chromium that results therefrom.

Figure 17C:
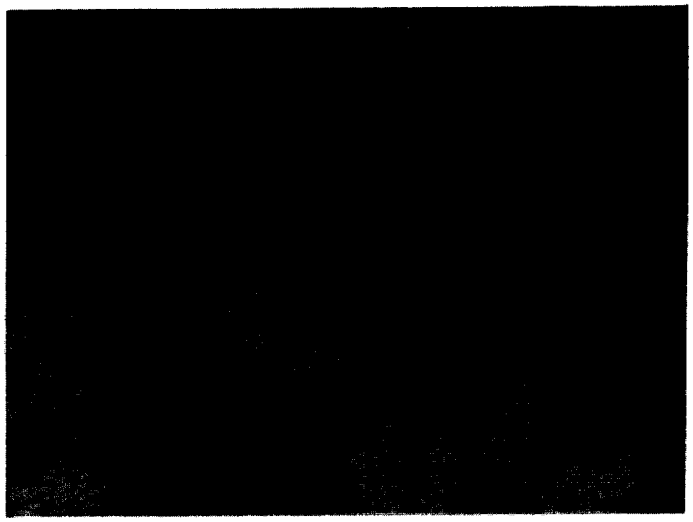
Figure 17B:
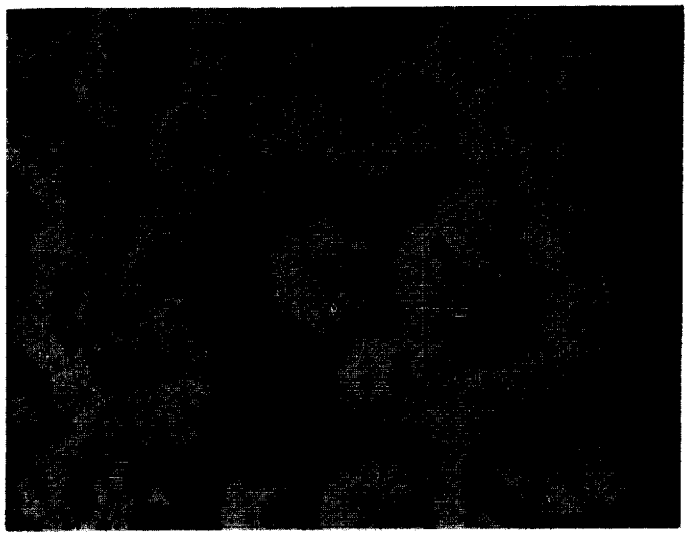
Figure 17A:
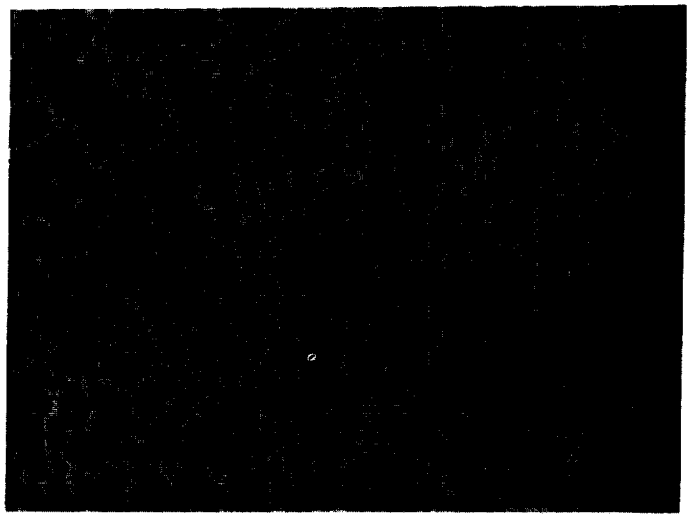
Figure 18C:
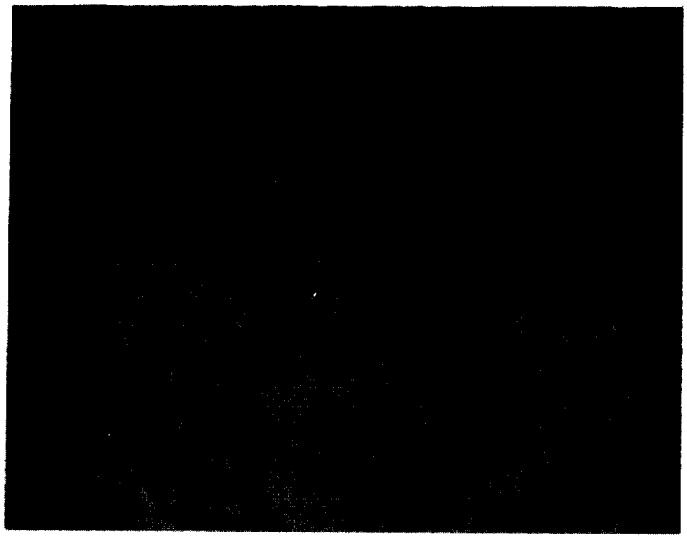
Figure 18B:
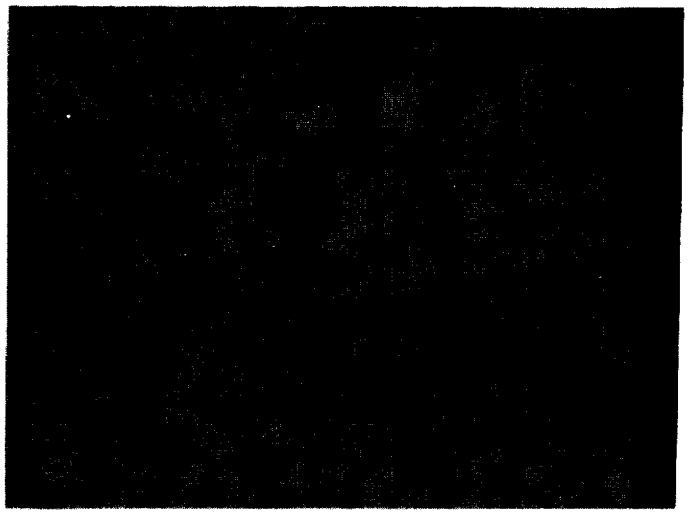
Figure 18A:
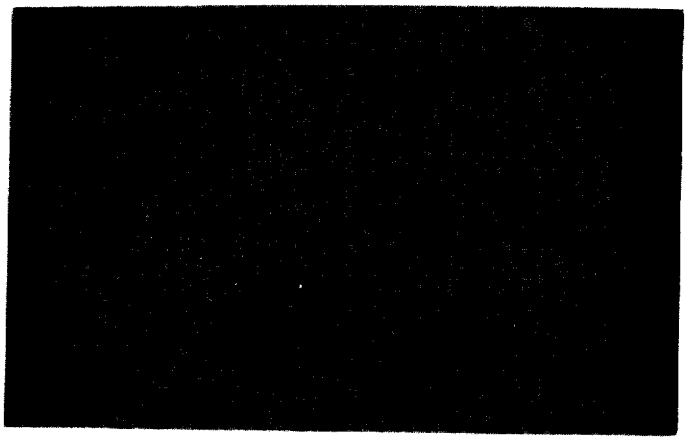

FIGS. 17A to 17C are representative scanning electron photomicrographs of another chromium plated mild steel sheet fabricated in accord with the principles of this invention and after exposure to current flow for 60 seconds and at magnifications of 1000×, 5000× and 10,000× respectively; and FIGS. 18A to 18C are representative scanning electron photomicrographs of a chromium plated stainless steel sheet fabricated in accord with the principles of this invention and after exposure to current flow for 60 seconds and at magnifications of 1000×, 5000× and 10,000× respectively.

The invention will be initially described in conjunction with the preparation of aluminum base lithographic sheet after which the application of the process to the fabrication of steel base lithographic plates will be described.

Figure 1:
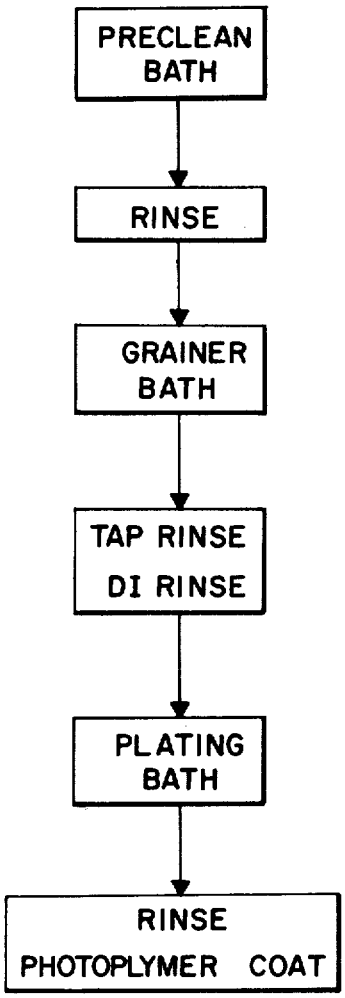
FIG. 1 is a schematic flow diagram of a sequence of fabrication steps that results in the provision of an improved chromium surface layer that is characteristic of the practice of their invention.

As generally depicted in FIG. 1, a metal substrate, suitably an 1100 aluminum alloy "litho" sheet in a gauge of about 0.008 to about 0.025, suitably 0.012 inch, is initially immersed in a precleaning bath to remove rolling or other lubricants, grit, surface oxidants and other detritus from the metal surface. A suitable precleaning bath comprises about 2 to 8 ounces of etchant per gallon of water, for example, about 4 ounces per gallon, of conventional, commercially available etchant, suitably Liquid Etchant as manufactured by The Hydrite Chemical Company of Milwaukee, Wis. Such commercial etchant is believed to consist of about 50% sodium hydroxide and a chelating agent, sodium glucoheptanate, in water. A presently preferred precleaning solution comprises 55 ounces of liquid etchant and 9.6 gallons of water (a 10 gallon solution).

Such precleaning bath apparently offers a wide tolerance range with respect to temperature, concentration and to the presence of impurities. For example, a satisfactory ultimate product was obtained and no readily observable variation in the final plated chromium crystal structure, grain texture and uniformity of coverage was noted where the temperature of the precleaning bath varied between 90° F. to 190° F., or where the immersion time of such 1100 aluminum alloy "litho" sheet varied from 5 to 120 seconds or where the solution concentration varied from 2 ounces to 8 ounces of liquid etchant per gallon of precleaner solution. Preliminary testing has also indicated that the character of the plated product does not change appreciably with respect to either crystal structure, grain texture or plating thickness where common contaminants such as 1 oz./gallon of mineral oil; $AlK(SO_4)_2$; $Fe(NO_3)_3$; sodium silicate; grainer solution or chromer solution was added to the precleaning bath.

Immediately after removal of the aluminum base metal substrate from the precleaning bath and without permitting the sheet surface to dry, the cleaned substrate is subjected to a thorough rinse, as by a strong multidirectional spray of 60°–70° F. water for 15 to 45 seconds. If the precleaned sheet is not properly rinsed, non-uniform plating may ultimately result.

Again without permitting the precleaned and rinsed sheet to dry, the cleaned and rinsed sheet is promptly immersed in a grainer bath. In contrast to the apparent lack of criticality of the precleaner bath, the composition, temperature, impurity level and immersion time in the grainer bath are all attended with some degree of criticality. Such grainer bath preferably comprises a bifluoride solution such as ammonium bifluoride ($NH_4HF_2$) or sodium bifluoride ($NaHF_2$) in water. A presently preferred grainer is ammonium bifluoride ($NH_4HF_2$).

Satisfactory operation has been achieved and an acceptable final product obtained with respect to the plated chromium crystal structure, grain texture and plating thickness, where grainer bath temperatures were maintained between 110° and 150° F.; the concentration of ammonium bifluoride was varied between 4.0 to 16.0 ounces per gallon and the immersion time varied between 10 to 120 seconds. In contradistinction to the foregoing however, the characteristics of the final plated product with respect to crystal structure and grain texture deteriorated significantly when immersion in the grainer bath was omitted entirely or where the bath temperature was reduced to 70° F. or where the immersion time was reduced to about 5 seconds. Such ultimate product deterioration was also noted when common contaminants, such as ferric or aluminum cations, were present in the grainer bath at relatively low concentrations.

A presently preferred set of operating parameters for grainer bath immersion, include a grainer solution strength of 8 ounces of ammonium bifluoride per gallon of water, a bath temperature of 120° F. and an immersion time of 60 seconds.

Following removal of the sheet from the grainer bath, the substrate is again immediately subjected to a strong multi-directional spray rinse 16 of 60°-70° F. water for 15 to 45 seconds and then to a strong multidirectional spray rinse 18 of 50° to 70° F. deionized water. Here again, if the substrate or sheet is not properly and thoroughly rinsed, non-uniform plating may result.

Again without permitting the rinsed sheet to dry, the chemically grained substrate is immersed in a selectively constituted electroplating bath and connected as the cathode in a plating circuit in which conventional 0.93 Pb/0.07 Sn plating anodes are employed.

A preferred plating bath composition is made up of 34 ounces of chromic oxide and 0.27 ounces of sulfuric acid per gallon of deionized water. In the production of a chromium plating thickness of 45 to 55 microinches from such bath of 34 oz. $Cr^{+6}$ and 0.27 oz. $SO_4^{-2}$ per gallon satisfactory results, insofar as the improved crystal structure and secondary grain texture are concerned, have been obtained at the following current densities (less than 5% ripple) and exposure times in a 95° F. bath.

| | Anode To Cathode Area Ratio |
|---|---|
| 500 Amp/ft$^2$ | 60 sec. (An/Ca of 1.26) |
| 700 Amp/ft$^2$ | 35 sec. (An/Ca of 1.06) |
| 900 Amp/ft$^2$ | 35 sec. (An/Ca of 0.91) |

In its broad aspects, the plating bath should be so constituted as to maintain a $Cr^{+6}/SO_4^{-2}$ ratio range of from about 75 to 180, plating currents of from about 300 to 1000 amperes/sq. ft. and plating times of about 30 to 60 seconds should be used. Satisfactory results with respect to chromium crystal structure, grain texture and plating thickness have been obtained by operations within the above parameters and where the bath temperature has been maintained between 90° and 100° F.

Information available to date indicates that presence of contaminants in the plating bath deleteriously affects both the character of the plated crystal structure, the secondary grain texture and the thickness of the chromium plate. For example, the presence of ferric or aluminum cations, as would result from the presence of ferric or aluminum salts at concentrations of about 1.0 oz./gal., caused a deterioration in both chromium crystal character and secondary grain texture, as well as a decrease in plated chromium thickness by 30-50%. The presence of ferric ammonium sulfate, zinc sulfate, and aluminum ammonium sulfate at concentrations of 1.0 oz./gal. had no apparent effect on the plated chromium crystal structure, but resulted in decrease in the plated chromium thickness of 5 to 10%. Also noted was that hydrofluoric acid added as a second catalyst removed all primary grain and decreased the plated chromium thickness by 6% at 0.1 oz./gal., 54% at 0.5 oz./gal. and 75% at 1.0 oz./gal.

The directly chromium plated aluminum base metal substrate resulting from the foregoing process steps is then rinsed in the manner heretofore described and, after drying, coated with a commercially available photo sensitive coating by conventional processes.

As mentioned earlier, the directly electrodeposited chromium layer that results from the practice of the above described process appears to be of singular character. FIGS. 2A-C through 11A-C pictorially delineate the formation and ultimate character of the improved chromium plated deposit under scanning electron photomicrographs at magnifications of 1000×, 5000× and 10,000× respectively. As will be apparent to those skilled in this art, such scanning electron photomicrographs depict only a very small area of the total sheet surface. It is extremely difficult, if not a practical impossibility, to rephotograph the exact same area in a series of exposures. Therefore, the depictions in the series of photomicrographs included in this application are representative of the surface character but are not repetitive photographs of exactly the same area.

Figure 2C:
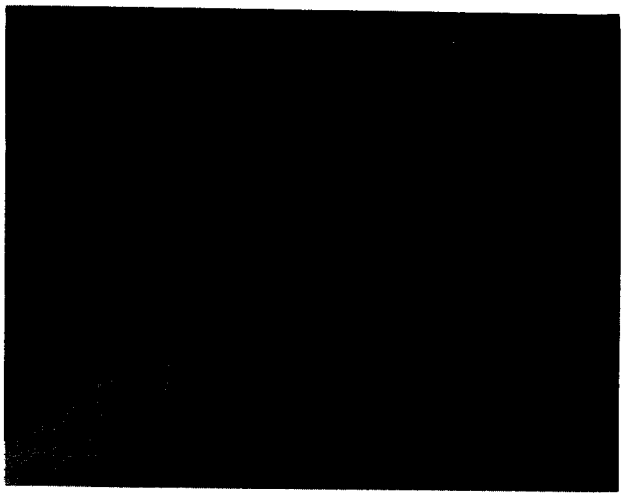
FIGS. 2A to 2C are representative scanning electron photomicrographs of the surface of an "as received" 1100 aluminum alloy sheet at magnifications of 1000×, 5000× and 10,000×.
Figure 2B:
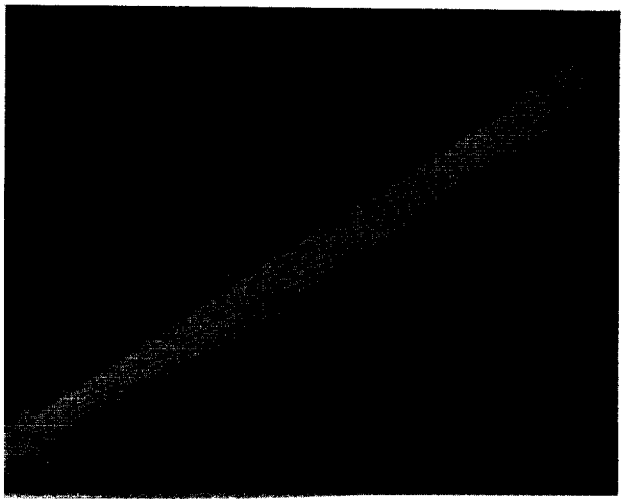
Figure 2A:
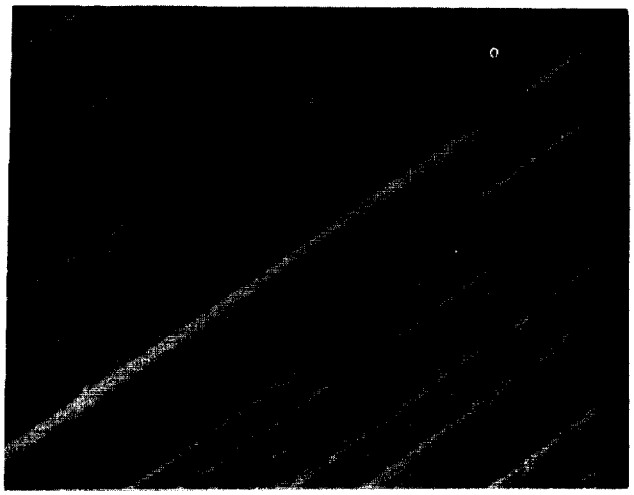

FIGS. 2A to 2C illustrate the surface characteristics of a typical "as received" surface of 0.012 inch thick 1100 aluminum alloy "litho" sheet having on the surface thereof residual oils, grit, surface oxide and other detritus.

Figure 3C:
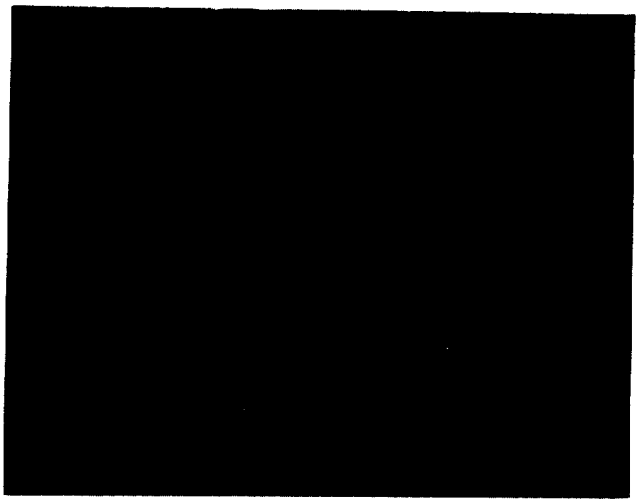
FIGS. 3A to 3C are representative scanning electron photomicrographs of the 1100 aluminum alloy sheet after 60 second immersion in a precleaning bath.
Figure 3B:
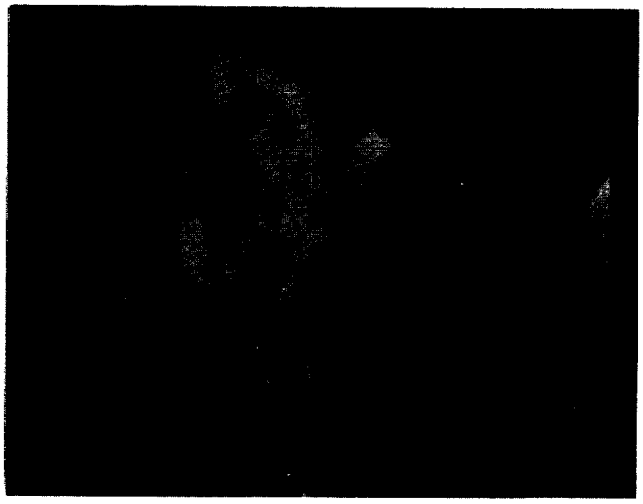
Figure 3A:
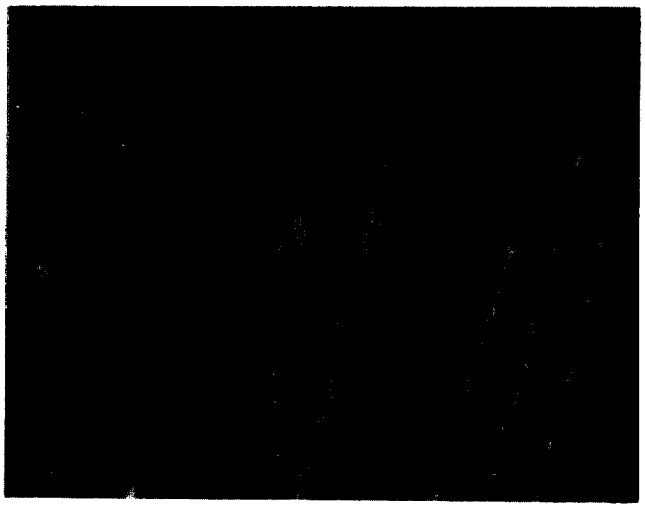

FIGS. 3A to 3C illustrate the surface of 1100 aluminum alloy "litho" sheet (taken from same coil) after 60 second immersion in the above described precleaning bath which cleans and partially etches the sheet surface.

Figure 4C:
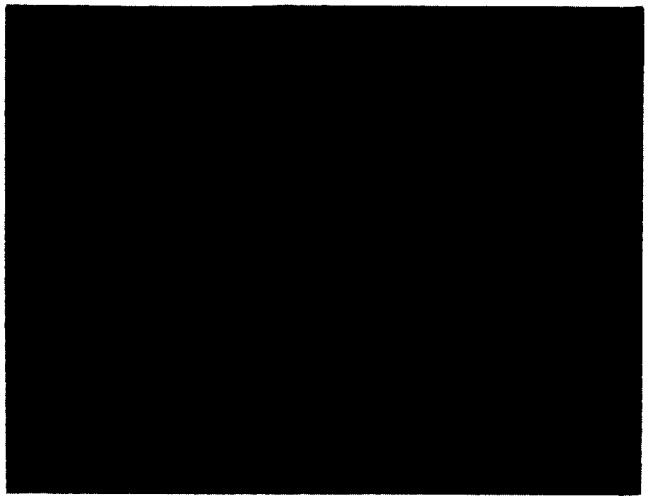
FIGS. 4A to 4C are representative scanning electron photomicrographs of the 1100 aluminum alloy sheet after immersion of the precleaned sheet in the selectively constituted grainer bath of this invention.
Figure 4B:
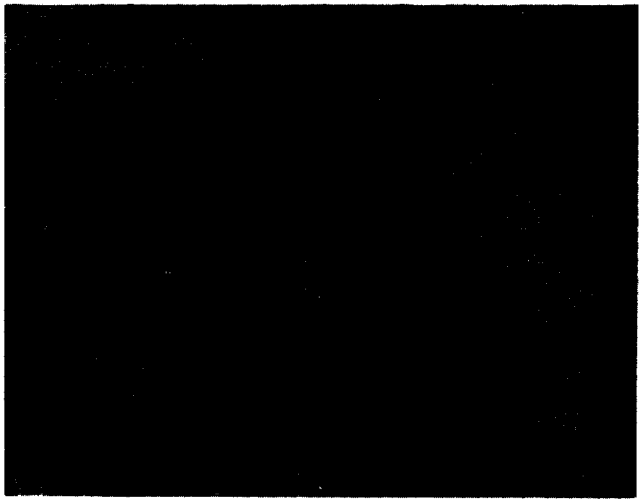
Figure 4A:
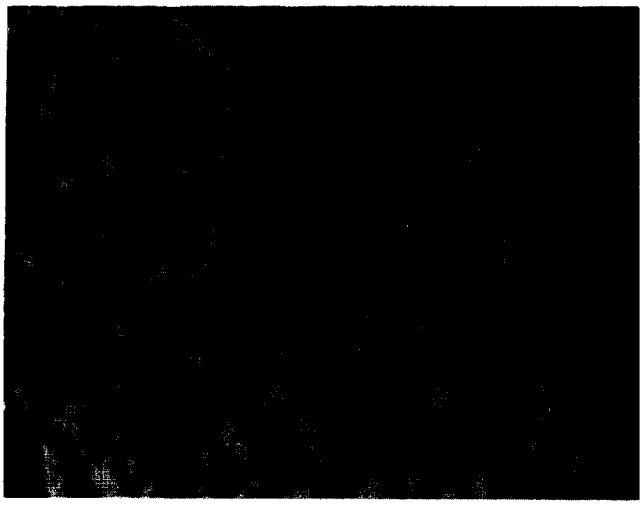

FIGS. 4A to 4C illustrate the surface of the precleaned 1100 aluminum alloy "litho" sheet (taken from the same general area of the same coil) after 60 second immersion in the above described bifluoride grainer bath. The chemical modification of the "litho" sheet surface to form a roughened and random mountain peak pit and valley surface texture is clearly apparent. Such surface texture is believed to differ appreciably from the surface textures that result from mechanical or electrochemical graining techniques.

Figure 5C:
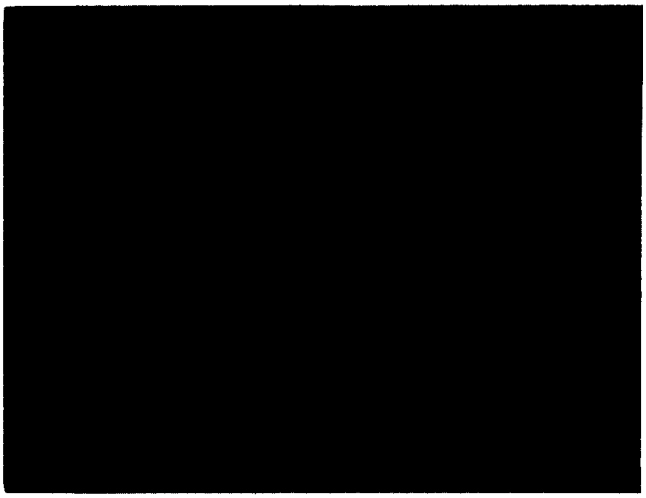
FIGS. 5A to 5C are representative scanning electron photomicrographs of the 1100 alluminum alloy sheet after immersion in the selectively constituted plating bath of this invention and exposure to current flow for 1 second.
Figure 5B:
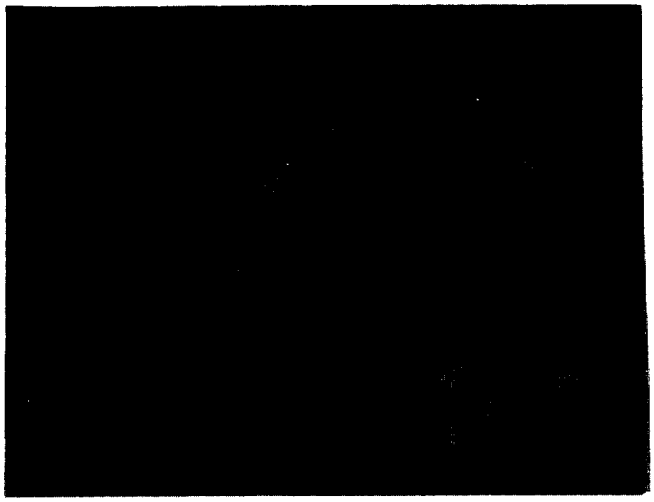
Figure 5A:
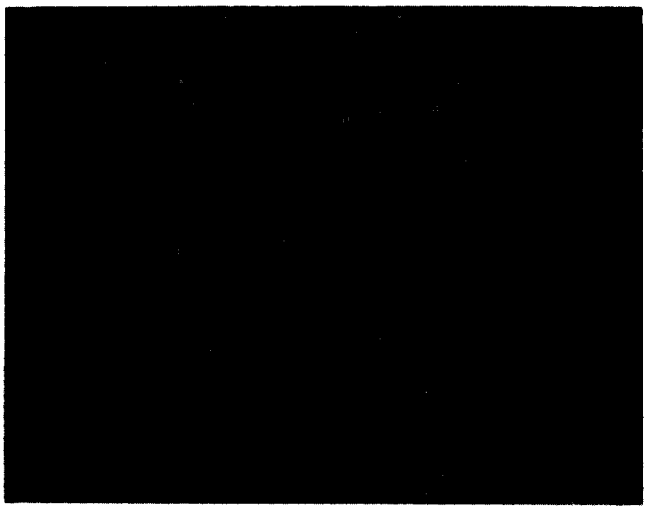

FIGS. 5A to 5C illustrate the surface of the grained litho sheet after 1 second exposure to current flow in the plating bath. Notable is the presence of widely separated and extremely small sized particles of electroplated chromium, most of which are spheroidal in character. It appears from a comparison of FIGS. 4B and 5B, that the particles of chromium, at least at the initiation of deposition, are much smaller in size than the pits and depressions in the selectively grained receiving surface of the metal substrate and are readily containable therewithin.

Figure 6C:
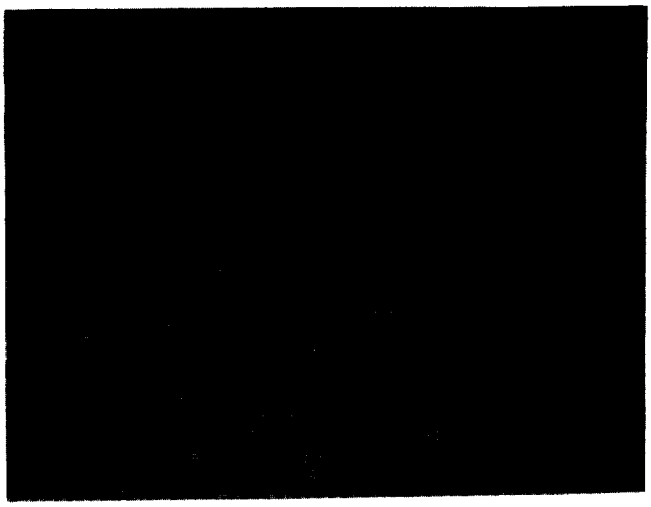
FIGS. 6A to 6C are representative of scanning electron photomicrographs of the 1100 aluminum alloy sheet after immersion in the selectively constituted plating bath of this invention and exposure to current flow for 5 seconds.
Figure 6B:
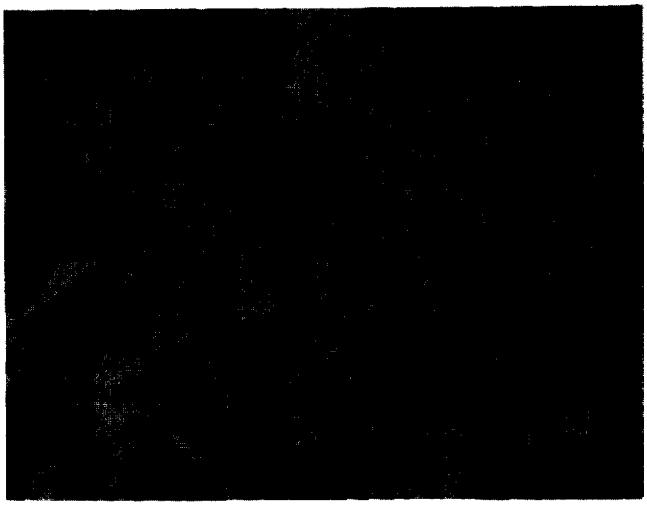
Figure 6A:
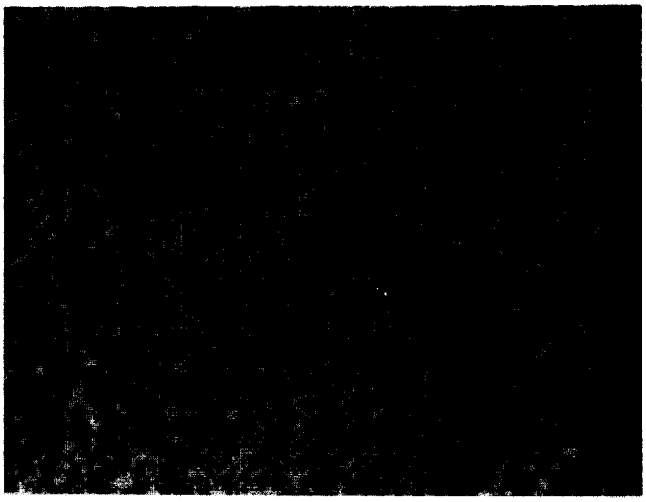

FIGS. 6A to 6C illustrate the surface of such 1100 aluminum alloy "litho" sheet after 5 seconds exposure to current flow in the selectively constituted plating bath. As is apparent, the chromium is now apparently being deposited in the form of small, composite and generally spheroidal particles, each of which is now apparently being constituted by multiplicities of the even smaller seed particles of spheroidate character as shown in FIGS. 5A to 5C. Such particles appear to be, at this early stage of plating, of individually discrete character although instances of apparent coalescive growth is taking place. As best shown in FIG. 6C (under 10,000× magnification) the deposited chromium particles are of generally spheroidal character, present a generally lobate curvilinear external contour and are characterized by a marked absence of planar exterior surfaces and relatively sharp protuberant angles. A comparison of FIGS. 6B and 6C indicate that the deposited particles of chromium appear to be compositely constituted of agglomerated or otherwise autogeneously bonded pluralities of smaller sized particles of markedly smaller dimension but of generally spheroidate character. Because of such composite constitution, the exterior surfaces of the particles, while still curvilinear in overall shape, are of generally lobular and bullate character and, as coalescive agglomeration proceeds, present marked localized departures from true spheroidal character and hence the term "lobular" will be herein utilized to describe the general character of the resultant deposit.

Figure 7C:
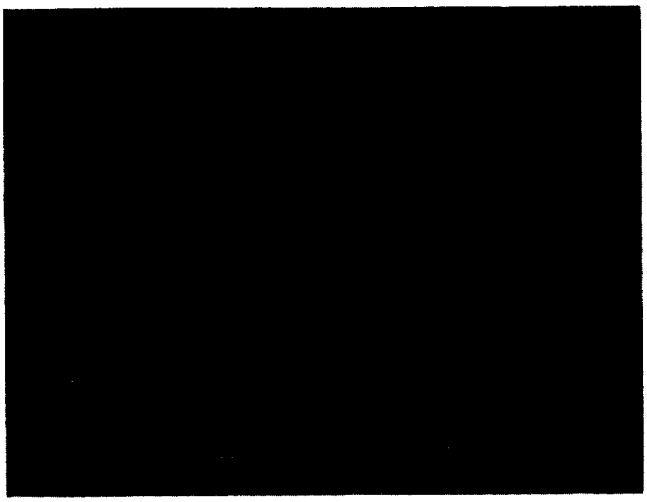
FIGS. 7A to 7C are representative scanning electron photomicrographs of the 1100 aluminum alloy sheet after immersion in the selectively constituted plating bath of this invention and exposure to current flow for 10 seconds.
Figure 7B:
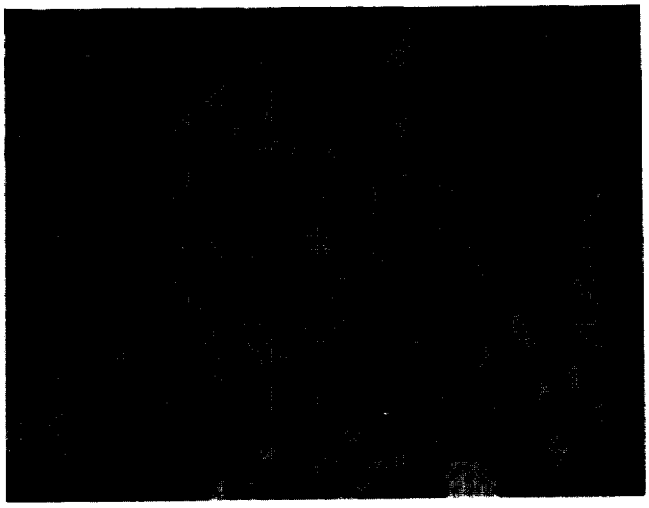
Figure 7A:
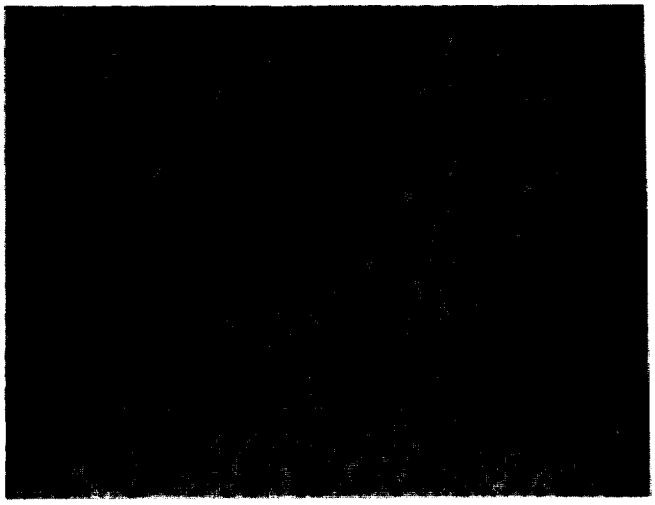

FIGS. 7A to 7C show the progressive formation of the electrodeposited chromium layer after 10 seconds exposure to the plating current within the bath. As shown, the particles appear to be growing in diameter. While, still appearing to be generally spheroidal in character, the growth is apparently being effected by the continued deposition of extremely small spheroids on the exposed surfaces thereof. Continuous formation of both new individual and composite agglomerated spheroids is apparently continuing to take place, with the gradual formation (see FIG. 7A) of a more continuous, insofar as exposed unplated areas of the basal substrate are concerned, deposited surface. Coalescive agglomeration of spheroids of progressively increasing diameter is apparently continuing to take place. (See FIG. 7C).

Figure 8C:
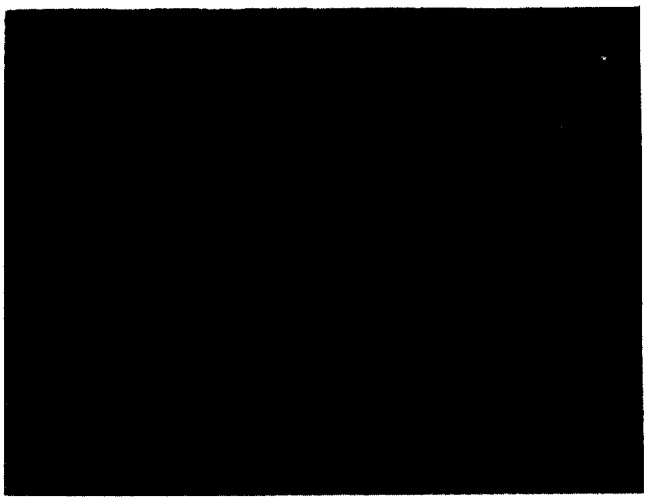
FIGS. 8A to 8C are representative scanning electron photomicrographs of the 1100 aluminum alloy sheet after immersion in the selectively constituted plating bath of this invention and exposure to current flow for 15 seconds.
Figure 8B:
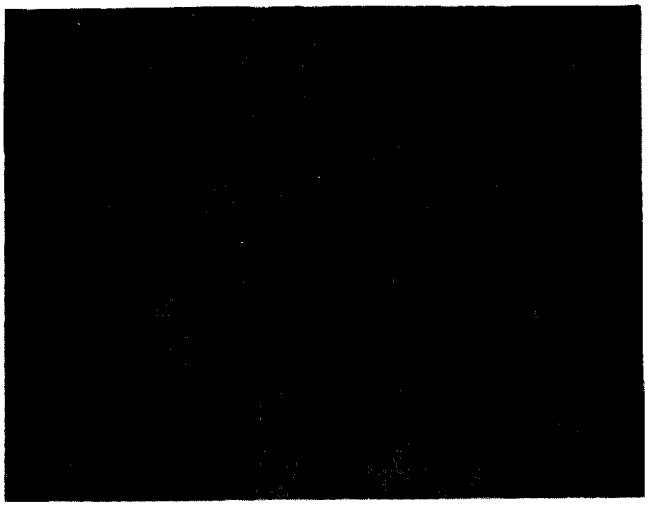
Figure 8A:
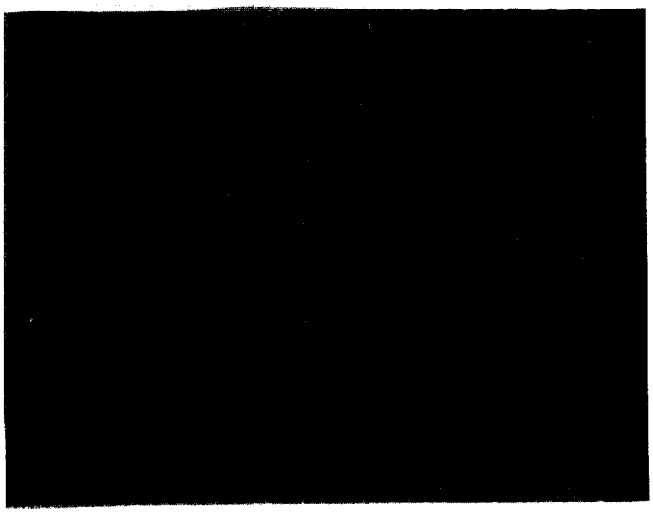

FIGS. 8A to 8C show the progressive formation of the electrodeposited chromium layer after 15 seconds exposure to current flow in the plating bath. As is apparent, the mechanics of deposition is apparently continuing by the progressive buildup of composite spheroidates of progressively increasing size with an accompanying increasing degree of coalescive buildup of the larger size agglomerates. It also appears, however, that the individual and progressively agglomerated particles continue to present a generally lobular curvilinear contour and are characterized by a marked absence of planar exterior surfaces and relatively sharp protuberant angles.

Figure 9C:
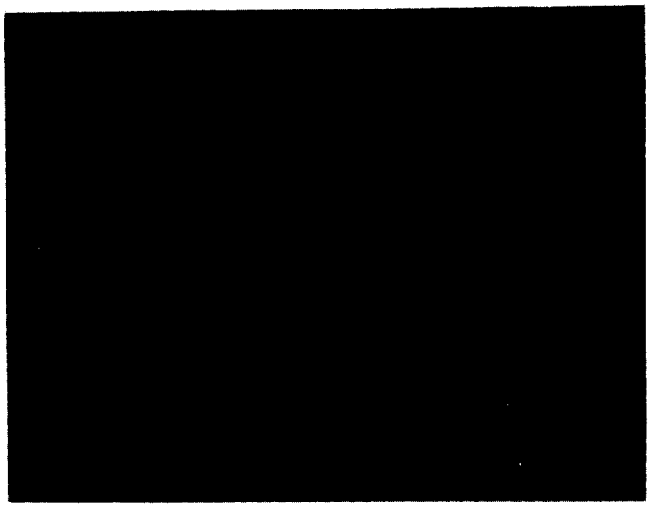
FIGS. 9A to 9C are representative scanning electron photomicrographs of the 1100 aluminum alloy sheet after immersion in the selectively constituted plating bath of this invention and exposure to current flow for 30 seconds.
Figure 9B:
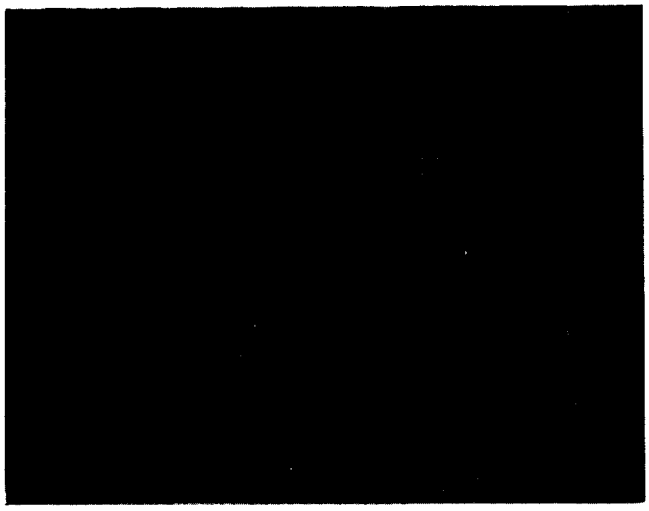
Figure 9A:
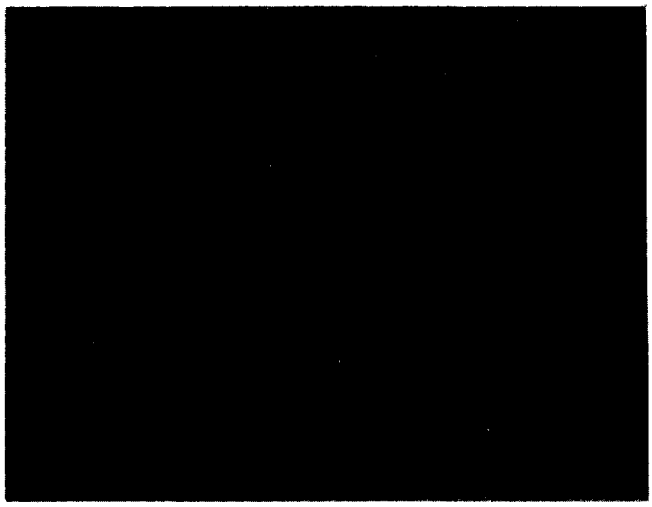

FIGS. 9A to 9C show the continued progressive formation of the electrodeposited chromium layer after 30 seconds exposure to current flow in the plating bath. The basic mechanics of deposition, as described above, are apparently continuing in a similar manner with a continued progressive buildup of spheroidates of increasing size from smaller size spheroidates and with an increasing degree of coalescive buildup of larger size agglomerates, is starting to be characterized (see FIG. 9B) by the presence of voids and tortuous passages within the composite layer. It is equally apparent, however, that the individual and progressively agglomerated spheroidate particles continue to present a generally lobular curvilinear contour and are characterized by a marked absence of planar exterior surfaces and relatively sharp protuberant angles. Likewise, the electrodeposited chromium layer, while being compositely constituted of agglomerated or otherwise joined pluralities of smaller sized particles of widely varying dimensions but of generally spheroidate or lobate character, is now of such overall continuity (see FIG. 9A) as to effectively present an almost continuous layer of chromium on the substrate surface.

Figure 10C:
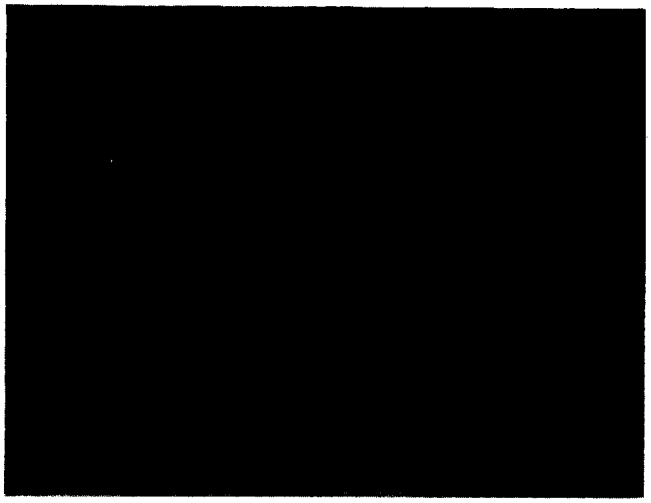
FIGS. 10A to 10C are representative scanning electron photomicrographs of the 1100 aluminum alloy sheet after immersion in the selectively constituted plating bath of this invention and exposure to current flow for 45 seconds.
Figure 10B:
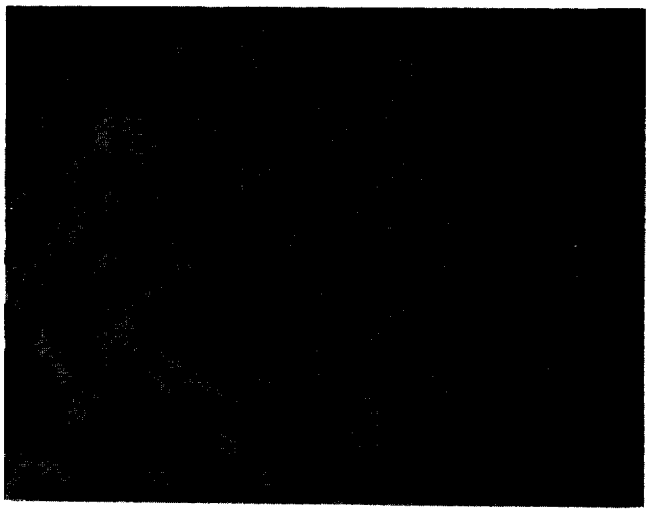
Figure 10A:
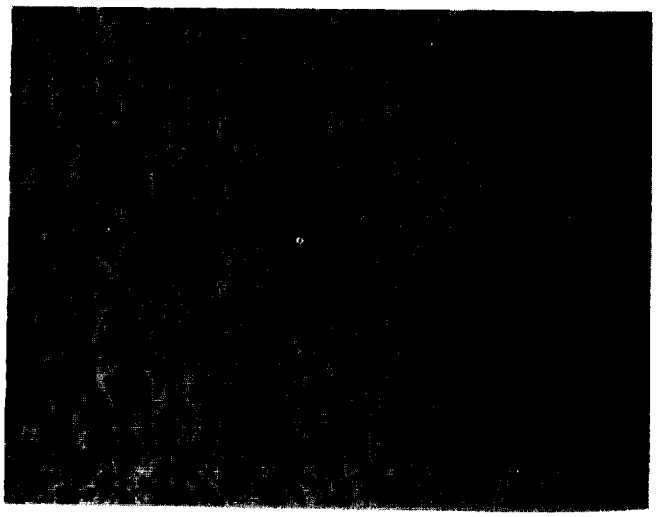

FIGS. 10A to 10C show the further progressive buildup of the electrodeposited chromium layer and as the same was constituted after 45 seconds exposure to current flow in the plating bath. FIG. 10A shows the fine secondary three dimensional grain texture that is continuously being formed. FIGS. 10B and 10C clearly depict the continued formation of spheroids of progressively increased dimension through coalescive agglomeration with a departure from the spheroid growth pattern for the larger sized agglomerates with the consequent formation of voids and tortuous passages in the nature of a capillary type labyrinth throughout the deposited layer. Such secondary grain texture and labyrinth type structures cooperate to present marked increases in available exposed surface area, both in the layer surface and interstices therebeneath.

Figure 11C:
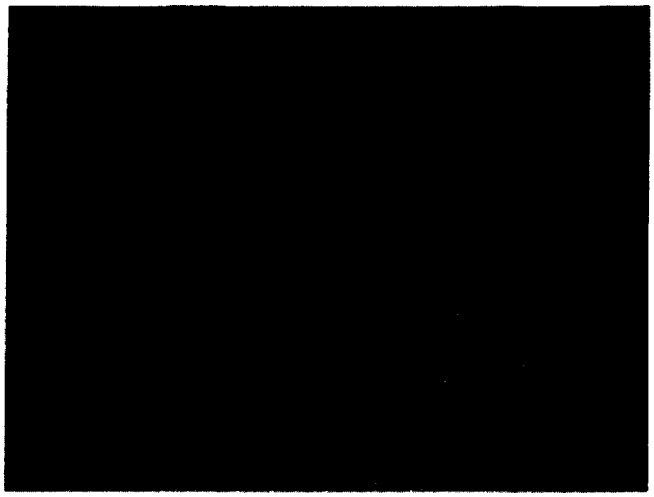
FIGS. 11A to 11C are representative scanning electron photomicrographs of the 1100 aluminum alloy sheet after immersion in the selectively constituted plating bath of this invention and exposure to current flow for 60 seconds.
Figure 11B:
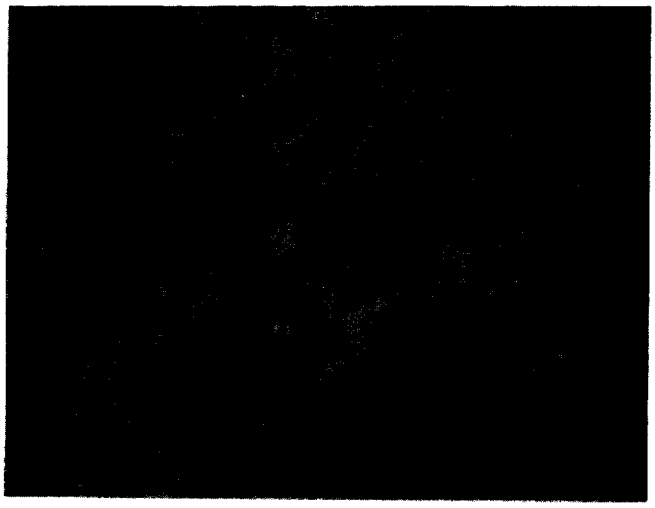
Figure 11A:
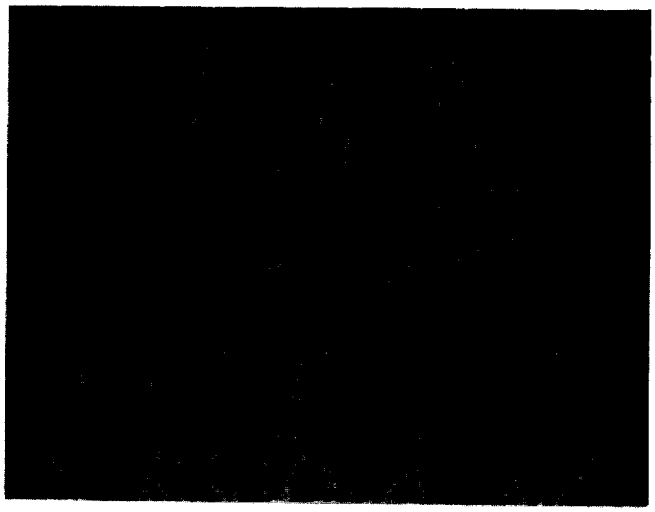

FIGS. 11A to 11C further depict the progressive formation of the electrodeposited chromium layer after 60 seconds exposure to current in the plating bath. Such further exposure has resulted in the continued coalescive agglomeration of spheroids of progressively increasing dimension with an apparent continued deposit of small sized spheroidate chromium particles on the exposed surfaces thereof. As here shown, a satisfactory depth of plating has been obtained. Further depth of plating thickness is generally not required.

The resultant finished structure, as shown in FIGS. 11A to 11C, has a secondary grained surface of microscopically rough character, but with an apparent total absence of planar exterior surfaces and sharp protuberant angles. As pointed out above, the electrodeposited chromium layer is compositely formed of myriads of progressively agglomerated spheroids that coalescively agglomerate to form exposed or otherwise accessible surface areas of markedly increased extent and which is made up of particles of generally curvilinear contour in the nature of rounded lobes or lobules, which impart an apparent bullate and/or nodular composite surface configuration. Such particle shape and buildup results in a labyrinth type structure of microscopic or capillary dimension or character, which, apart from presenting markedly increased exposed and available surface areas, also provide a subterranean labyrinth structure of capillary dimension for reception, retention and increased adherence of photo sensitive material or the like.

Figure 12C:
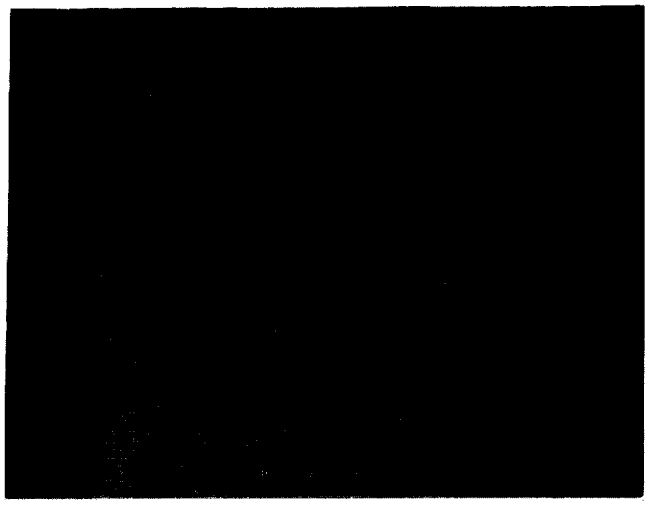
FIGS. 12A to 12C are scanning electron photomicrographs of a chromium plated aluminum substrate lithograph sheet as commercially offered at an earlier date by Sumner Williams under the name "Lectra Chrome".
Figure 12B:
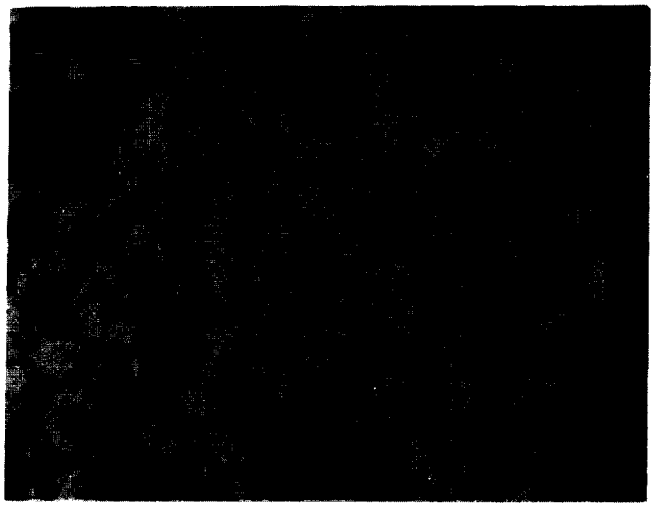
Figure 12A:
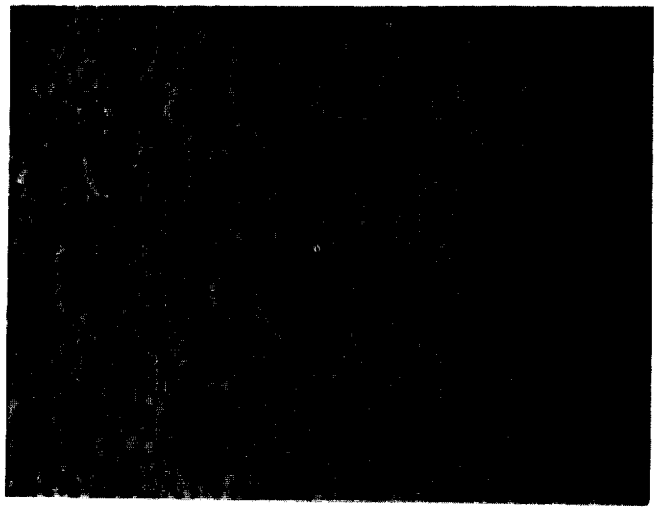
Figure 13C:
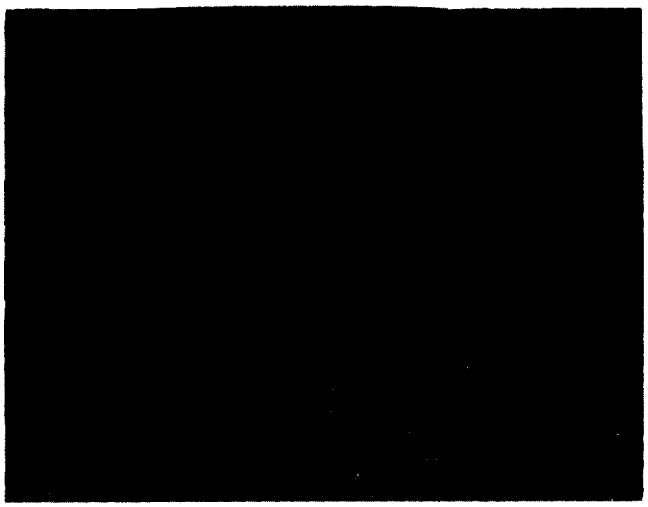
FIGS. 13A to 13C are scanning electron photomicrographs of a chromium plated aluminum substrate lithograph sheet as commercially offered at an earlier date by Quadrimetal under the name "PSN" litho sheet.
Figure 13B:
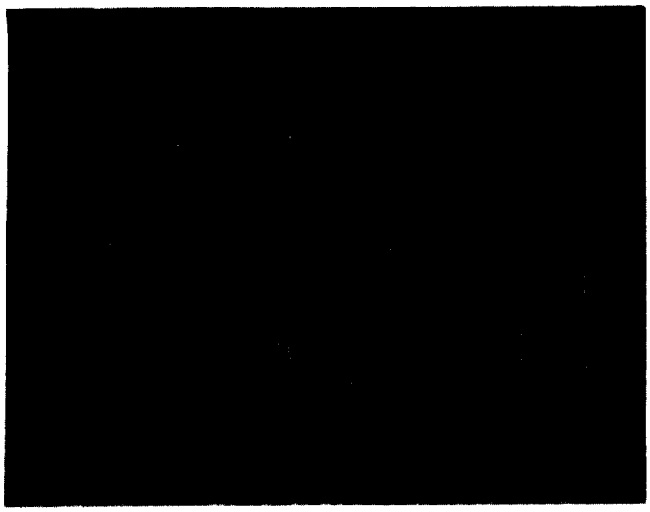
Figure 13A:
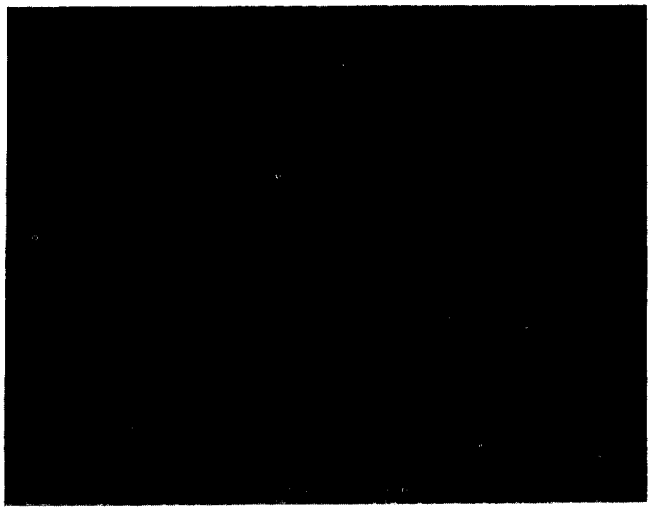
Figure 14C:
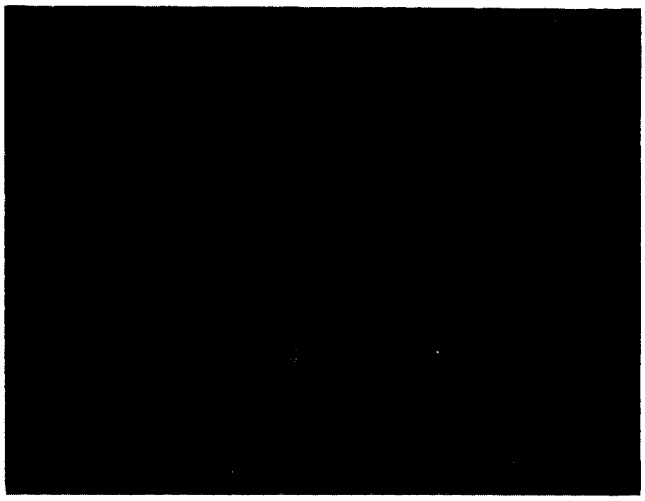
FIGS. 14A to 14C are scanning electron photomicrographs of a chromium plated aluminum substrate lithograph sheet as commercially offered at an earlier date by Quadrimetal under the name "PSP" tri-metal sheet.
Figure 14B:
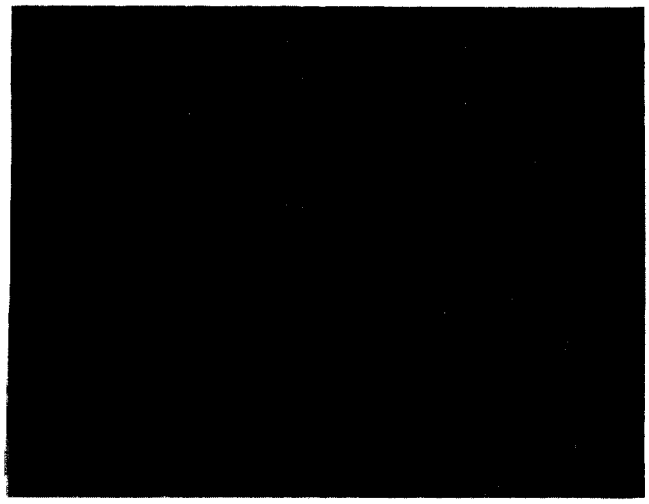
Figure 14A:
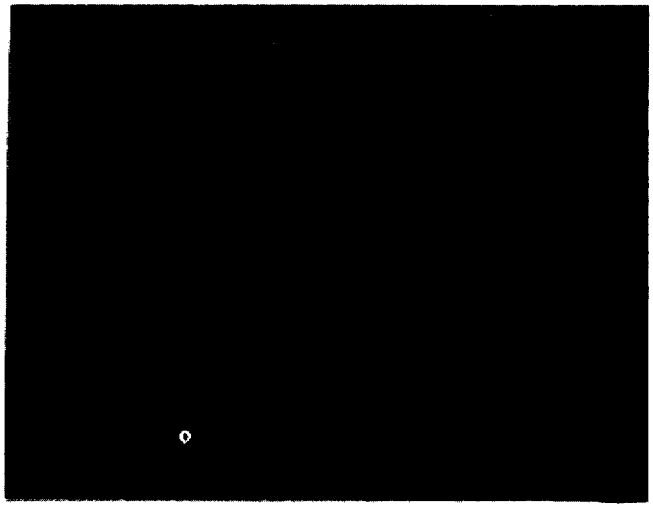
Figure 15C:
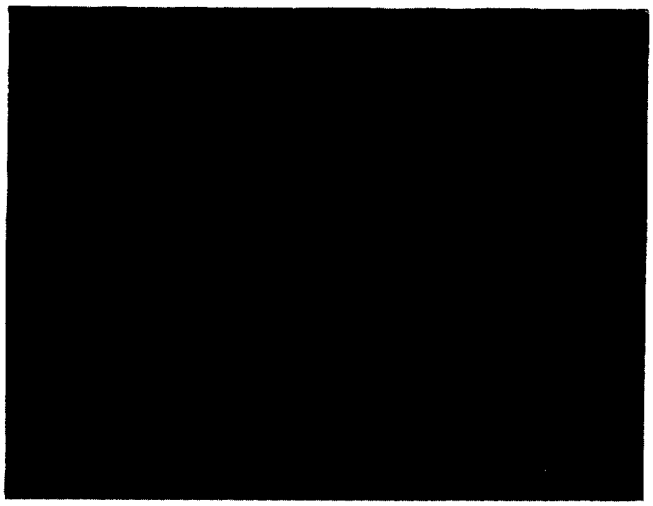
FIGS. 15A to 15C are scanning electron photomicrographs of a chrominum plated aluminum substrate lithograph sheet as commercially offered at an earlier date by Quadrimetal under the name "Posalchrome"
Figure 15B:
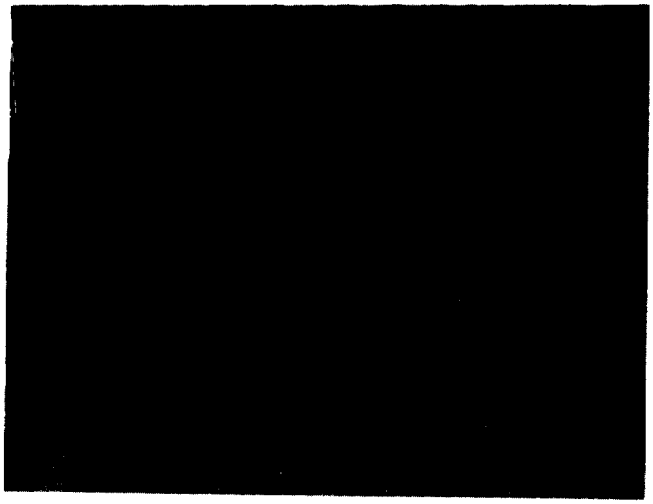
Figure 15A:
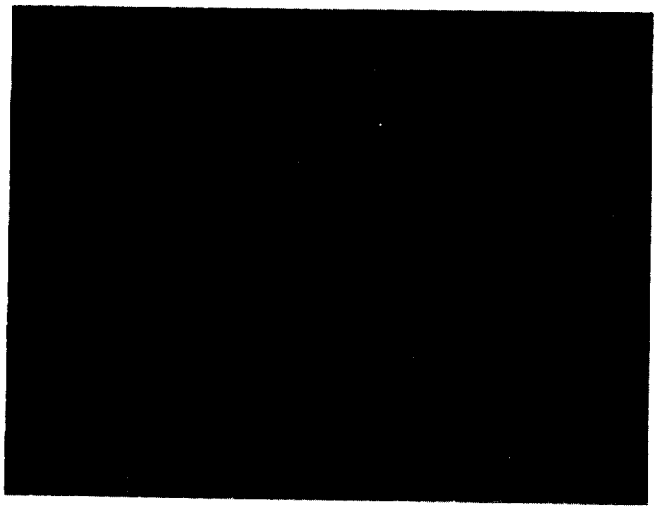
Figure 16C:
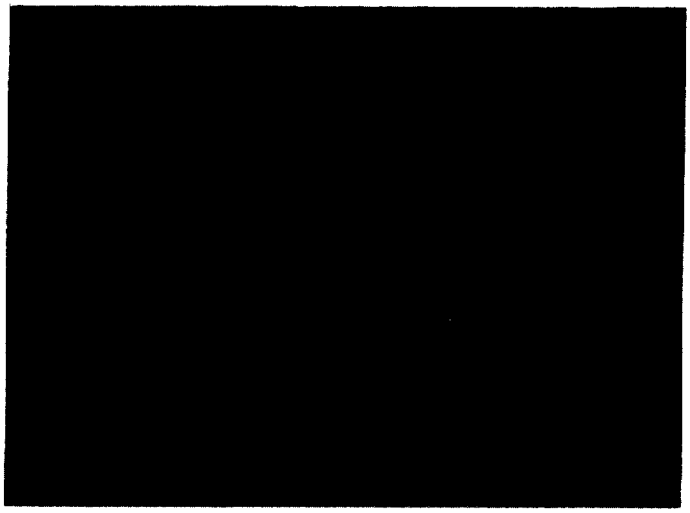
FIGS. 16A to 16C are representative scanning electron photomicrographs of a chromium plated mild steel sheet fabricated in accord with the principles of this invention and after exposure to current flow for 60 seconds and at magnifications of 1000×, 5000× and 10,000× respectively.
Figure 16B:
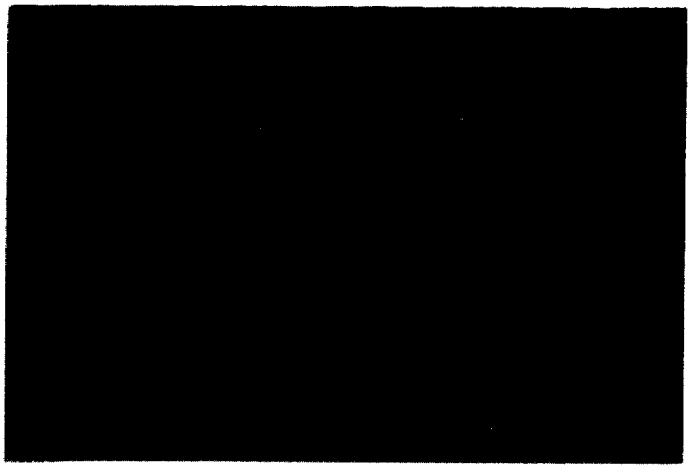
Figure 16A:
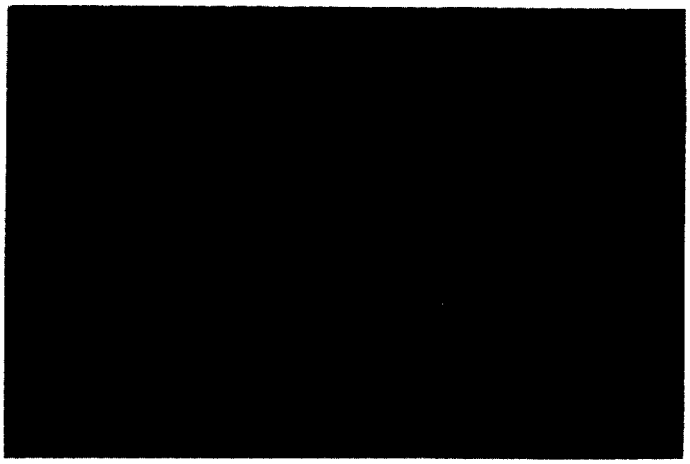

As will now be apparent to those skilled in this art, the generally lobate character of the electrodeposited chrome layer obtained by the practice of this invention differs markedly, both as to crystal structure and grain texture, from conventionally plated lithograph sheet that is commercially available. For the purposes of comparison FIGS. 12A to 12C show the crystal structure and grain texture, from conventionally plated lithograph sheet that is commercially available. For the purposes of comparison FIGS. 12A to 12C show the crystal structure and grain texture of an earlier lithograph sheet offered by Sumner Williams under the name "Lectra Chrome". Such product which is believed to be made of an aluminum substrate, an intermediate layer of copper and an exposed chromium surface, clearly is not of lobate character and is characterized by the presence of essentially planar exterior surfaces and relatively sharp protuberant angles. Such configuration is also characteristic of Quadrimetal's "PSN" sheet (Brass/Al) as shown in FIGS. 13A to 13C; Quadrimetal's "PSP" tri-metal sheet (Al/Cu/Cr) as shown in FIGS. 14A to 14C and Quadrimetal's "Posalchrome", purportedly (Cr/Al) as shown in FIGS. 15A to 15C.

As will now also be apparent to those skilled in this art, the lobular or spheroidate particles that compositely form the deposited chrome layer in accord with the principles of this invention are sized somewhere between ultramicroscopic and superatomic rather than microscopic (100×) in dimension. While not fully understood at the present time, it is believed that the chemically grained surface and/or the mechanics of the initial and continuing deposition of chromium particles operate in some way to overcome the recognized electroplating incompatability of chromium on aluminum. Whether such markedly improved adhesion and cohesion between the electrodeposited chromium and the surface of the aluminum base substrate is due to chemical interreaction or physical interrelationships or to a combination of both is not presently known but the improved resultant adhesion between the electrodeposited chromium and the aluminum surface is readily apparent.

The hereinabove described process steps with respect to precleaning, rinsing, immersion in and composition of the grainer bath, rinsing in both plain and deionized water followed by immersion in the selectively constituted plating bath and plating under the above delineated current densities results in an electrodeposited layer of chromium on a steel base substrate of essentially the same character as described above for aluminum base substrate.

By way of example FIGS. 16A to 16C and 17A to 17C are illustrative scanning photomicrographs, under the same degrees of enlargement as for the earlier Figures relating to aluminum base substrate material, of two directly chromium plated mild steel substrates after processing in accord with the principles of this invention and after one minute of exposure to current flow. FIGS. 18A to 18C are similarly representative of the processing a stainless steel substrate in accord with the principles hereof.

In each of these illustrative steel base samples, the resultant finished structure has a secondary grained surface of microscopically rough character, but with an apparent total absence of planar exterior surfaces and sharp protuberant angles. The electrodeposited chromium layer again clearly appears to be formed of myriads of progressively agglomerated spheroids that coalescively agglomerate to form exposed or otherwise accessible surface areas of markedly increased extent and which is made up of particles of generally curvilinear contour in the nature of rounded lobes or lobules, which impart an apparent bullate and/or nodular composite surface configuration. Such particle shape and buildup results in a labyrinth type structure of microscopic or capillary dimension or character, which, apart from presenting markedly increased exposed and available surface areas, also provide a subterranean labyrinth structure of capillary dimension for reception, retention and increased adherence of photo sensitive material or the like.

In complement to the above, the much finer nature of the deposited chromium particles and the grain texture apparently resulting from the singular or coalescively agglomerated spheroid shape thereof results in a highly anisotropic and discontinuous exposed surface and a labyrinthine undersurface structure of capillary dimension. Such distinctive surface and undersurface configuration provides for a high degree of photo sensitive coating adhesion and permitted usage of the resulting product as a surface plate.

Preliminary information has indicated that lithographic plates formed in accordance with the principles of this invention have markedly extended the permitted running life of aluminum or steel base plates from about 250,000 to 300,000 impressions up to 600,000 or 1,000,000 or even more impressions due to increased wear resistance of the exposed chrome surfaces and increased adhesion of the exposed photo sensitive coatings thereon.

I claim:

1. In the direct electrodeposition of chromium on the surface of a metal substrate, the steps of immersing said metal substrate in a controlled temperature grainer bath consisting of water and a bifluoride selected from the group consisting of ammonium bifluoride and sodium bifluoride and in a concentration of about 4 to 16 ounces of selected bifluoride per gallon of water, for at least 10 seconds;

immersing said bifluoride grained metal substrate with no intervening treatment other than optional rinsing in a plating bath selectively constituted of water, chromic oxide and sulfuric acid in amounts to maintain a $CR^{+6}/SO_4^{-2}$ ratio in the range of about 75 to 180;

and exposing said immersed metal substrate in said plating bath to a plating current in the range of 300 to 1000 amperes per square foot for at least 30 seconds.

2. The method as set forth in claim 1 wherein the temperature of said plating bath is maintained between about 90° and 100° F.

3. The method as set forth in claim 1 wherein said metal substrate is aluminum base alloy.

4. In the direct electrodeposition of chromium on the surface of an aluminum base substrate, the step of immersing said aluminum base substrate in a grainer bath consisting of water and a bifluoride selected from the group consisting of ammonium bifluoride and sodium bifluoride and in a concentration of from about 4 to 16 ounces of selected bifluoride per gallon of water, for at least 10 seconds immediately prior to optional rinsing and exposure to plating current.

5. The method as set forth in claim 4 wherein the temperature of said grainer bath is maintained between about 110° and 150° F.

6. In the direct electrodeposition of chromium on the surface of an aluminum base substrate, the steps of immersing said aluminum base substrate in a grainer solution consisting 8 of from about 4 to 16 ounces of ammonium bifluoride per gallon of water for at least 10 seconds;

rinsing said aluminum base substrate immediately following its removal from said grainer solution;

immersing said bifluoride grained aluminum base substrate directly in a plating bath selectively constituted of water, chromic oxide and sulfuric acid in amounts to maintain a $Cr^{+6}/SO_4^{-2}$ ratio in the range of about 75 to 180;

and exposing said immersed metal substrate in said plating bath to a plating current in the range of 300 to 1000 amperes per square foot for at least 30 seconds.

7. The method as set forth in claim 6 wherein said grainer solution is maintained at a temperature between about 110° and 150° F.

8. The method as set forth in claim 6 wherein said grainer solution consists of about 8 ounces of ammonium bifluoride per gallon of water and said aluminum base substrate is immersed therein for about 60 seconds at a bath temperature of about 120° F.

9. The method as set forth in claim 6 wherein said rinsing step is effected with deionized water.

10. The method as set forth in claim 6 wherein said plating bath is selectively constituted of about 34 ounces of chromic acid and about 0.27 ounces of sulfuric acid per gallon of deionized water.

11. The method as set forth in claim 6 wherein said plating bath is maintained at a temperature between about 90° and 100° F.

12. The method as set forth in claim 6 including the step of coating said electrodeposited chromium surface with a photo sensitive material.

13. In the fabrication of aluminum base lithograph sheet having chromium directly electrodeposited on the surface thereof, the steps of immersing said aluminum base substrate in a 110° to 150° F. grainer solution consisting of about 8 ounces of ammonium bifluoride per gallon of water for about 60 seconds;

rinsing said aluminum base substrate immediately following its removal from said grainer solution;

immersing said bifluoride grained aluminum base substrate directly in a plating bath selectively constituted of about 34 ounces of chromic acid and about 0.27 ounces of sulfuric acid per gallon of deionized water;

and exposing said immersed aluminum base substrate in said plating bath to a plating current in the range of 300 to 1000 amperes per square foot for at least 30 seconds with the plating bath temperature being maintained between about 90° and 100° F.

14. The method as set forth in claim 13 including the step of coating said electrodeposited chromium surface with a photo sensitive material.

* * * * *